US006561507B1

(12) United States Patent
Pollock

(10) Patent No.: US 6,561,507 B1
(45) Date of Patent: May 13, 2003

(54) APPARATUS FOR DECELERATING AND SHINGLING SIGNATURES

(75) Inventor: David Clarke Pollock, Somersworth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 722 days.

(21) Appl. No.: 08/923,449

(22) Filed: Sep. 4, 1997

(51) Int. Cl.[7] ..... B41F 13/58
(52) U.S. Cl. ..... 271/182; 271/202; 271/203
(58) Field of Search ..... 271/182, 202, 271/203, 270, 184; 493/357, 424, 436, 426, 425, 324

(56) References Cited

U.S. PATENT DOCUMENTS

| | | | | |
|---|---|---|---|---|
| 3,724,840 A | * | 4/1973 | Kuckhermann | 271/270 |
| 3,899,947 A | * | 8/1975 | Faltin | 270/21 X |
| 4,200,276 A | * | 4/1980 | Marschke | 271/202 X |
| 4,214,744 A | * | 7/1980 | Evans | 271/202 |
| 4,240,856 A | * | 12/1980 | Craemer et al. | 271/203 |
| 4,344,610 A | * | 8/1982 | Jeschke et al. | 270/47 X |
| 4,436,302 A | * | 3/1984 | Frye et al. | 271/202 |
| 4,925,179 A | | 5/1990 | Breton et al. | 271/187 |
| 5,102,111 A | * | 4/1992 | Reponty | 271/202 |
| 5,112,033 A | | 5/1992 | Breton | 270/47 |
| 5,180,160 A | | 1/1993 | Belanger et al. | 271/315 |
| 5,605,267 A | | 2/1997 | Whitten | 226/91 |

FOREIGN PATENT DOCUMENTS

| | | |
|---|---|---|
| DE | 952 493 | 11/1956 |
| EP | 0 066 529 | 12/1982 |
| EP | 0 259 650 | 3/1988 |
| EP | 0 463 419 | 1/1992 |

OTHER PUBLICATIONS

Patent Abstracts of Japan, Publication No. 55002548, Application No. 53074597, "Delivery Apparatus for Rotary Press," Published Jan. 1980, 1 page.

* cited by examiner

*Primary Examiner*—Patrick H. Mackey
(74) *Attorney, Agent, or Firm*—Kenyon & Kenyon

(57) ABSTRACT

A folder apparatus includes a conveyor and knock-down wheel assembly to receive signatures from, for example, a tape system output. The conveyor and knock-down wheel assembly slow down the signatures from the tape system and create a shingled output stream of signatures. Multiple conveyor and knock-down wheel assemblies may be employed to attain a desired speed and signature spacing.

31 Claims, 2 Drawing Sheets

APPARATUS FOR DECELERATING AND SHINGLING SIGNATURES

FIELD OF THE INVENTION

The present invention relates to printing presses and more particularly to a device for decelerating signatures in the folder section of a printing press.

BACKGROUND INFORMATION

In web fed printing presses, a continuous web of paper is fed from an infeed roll, through various processing units, such as the print units, dryer, chill unit, slitters, folder, stackers, log bundlers, and print rolls, in order to produce a printed product. Typically, after the web has been printed and dried, it is folded and cut. When the web is cut, the individual products that result are referred to as signatures. Often, the folder delivers signatures faster than they can be processed by the succeeding processing unit. Therefore, it is necessary to slow the signatures' speed. It may also be preferable to place the signatures into a shingled formation wherein the leading edge of one signature overlaps the trailing edge of the signature preceding it.

Known methods and apparatus for slowing down signatures include fan wheels, as described in U.S. Pat. Nos. 5,112,033, 5,180,160 and 4,925,179, each of which is incorporated herein by reference. Generally, signatures are delivered from a folder to a press delivery conveyor by a fan wheel. The fan wheel includes a plurality of fan blades that form fan pockets for receiving the signatures from the folders as the fan wheel rotates. The signatures may be stripped from the fan wheel by a stripper and may be transferred onto, for example, a delivery conveyor. However, there are problems associated with the use of fan wheels such as marking, dog-earing and bottom-of-pocket rips or dents.

OBJECTS AND SUMMARY OF THE INVENTION

It is an object of the present to provide an apparatus that decelerates and shingles signatures including: a tape system adapted to receive the signatures from a folder, the tape system increasing a speed of the signatures; a first conveyor belt disposed adjacent to the tape system, the first conveyor belt receiving signatures from the tape system, the first conveyor traveling at a speed slower than the tape system; a first knock-down wheel rotatably mounted above the first conveyor and in rolling engagement with the first conveyor, the knock-down wheel being adapted to force signatures into conformance with the speed of the first conveyor; a second conveyor belt disposed adjacent to and downstream from the first conveyor belt adapted to receive signatures from the first conveyor, the second conveyor traveling at a slower speed than the first conveyor, and a second knock-down wheel rotatably mounted above the second conveyor and in rolling engagement with the second conveyor, the second knock-down wheel adapted to force the signatures into conformance with the speed of the second conveyor.

Using the device according to the present invention, cut and folded signatures are decelerated and placed into a shingled stream. The shingle spacing may be adjusted in subsequent stages. The device uses a system of tapes and rollers, conveyors, knock-down wheels, and tracking drive. According to the present invention, signatures may be delivered from a folder to a conveyor system without entering into a fan wheel. Thus, a shingled delivery system comprising conveyors and knock-down wheels may be employed rather than a fan wheel or deceleration drum system, the cost of which may be prohibitive in certain applications.

According to the present invention, signatures are delivered by, for example, a tape drive system from the folder to a conveyor. The signatures are deposited onto a conveyor that is traveling more slowly than the tape drive system. The signatures may be contacted by and pressed into contact with the conveyor by knock-down wheels. In this manner, the signature is slowed down to travel with the more slowly moving conveyor belt. A series of conveyor belts and knock-down wheels may be used to achieve a desired amount of deceleration using incremental steps. Such an incremental approach may be beneficial in achieving a desired deceleration without abrupt decelerations that could damage and mark the signatures. If too great a deceleration is attempted with, for example, a single stage knock-down wheel/conveyor system, the signature may become marked or damaged. Thus, high speed printing systems may benefit by using multiple conveyor/knock-down wheel arrangements.

Other objects, advantages, and characteristics of the present invention will become apparent in view of the description and accompanying drawings that follow.

DETAILED DESCRIPTION OF THE INVENTION

Figures 1, 3:
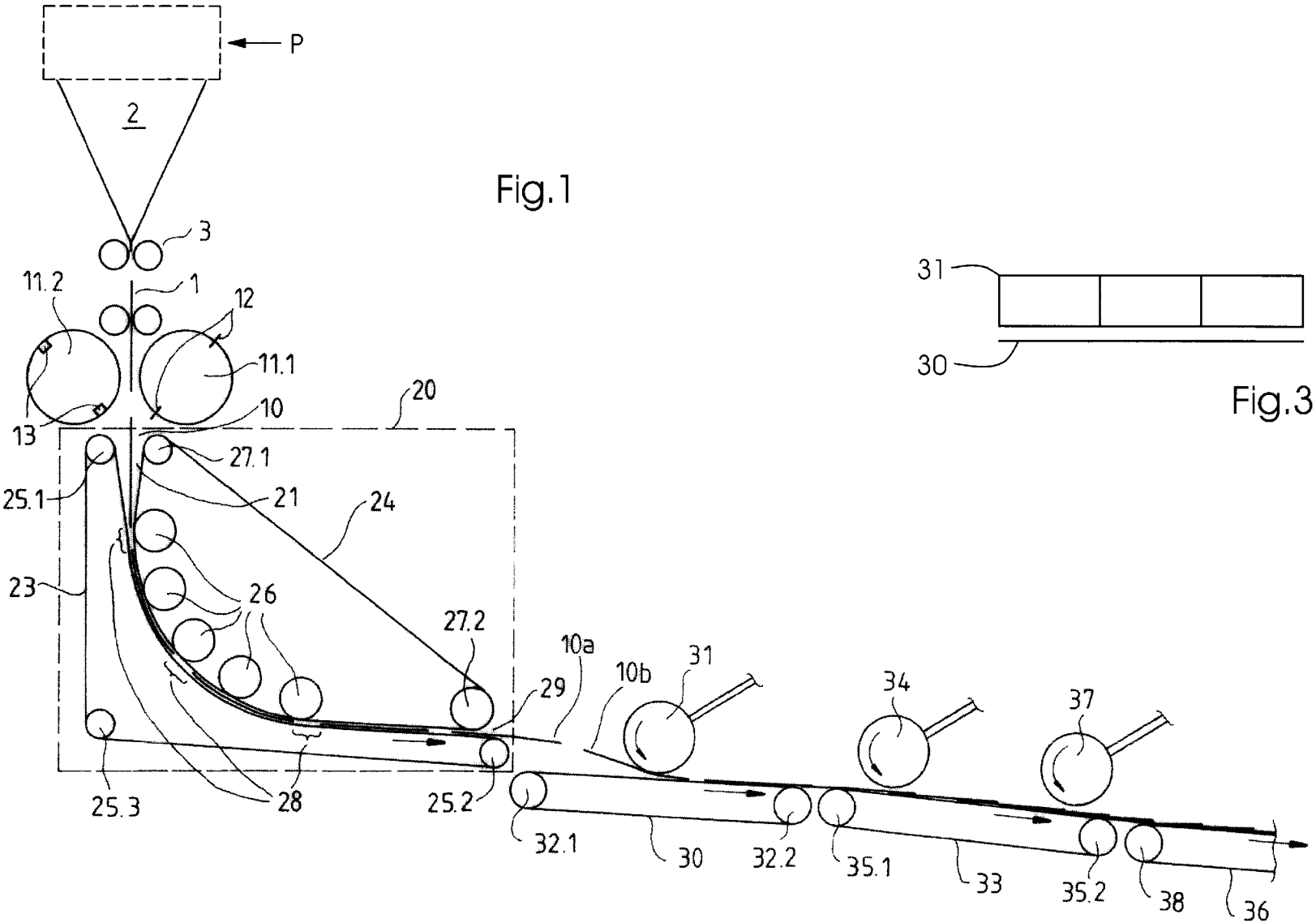
FIG. 1 shows a side view of a former folder section of a printing press including the slow down mechanism according to the present invention.
FIG. 3 shows a front view of a knock-down wheel with coaxially mounted idler wheels.

FIG. 1 shows a former board 2 of a folder of a printing press P that has a web 1 fed over it and folded. Below the former board 2, a pair of nip rolls 3 is positioned to receive the web 1 that comes off the former board 2. A second set of nip rolls 4 may be located subsequent and adjacent to the nip rolls 3, to facilitate handling the web 1 as it is fed over the former board. Downstream of the nip roll pairs 3 and 4, cutting cylinders 11.1 and 11.2 are positioned to receive and cut the web 1 into individual signatures 10.

The signatures 10 pass from the cutting cylinders 11.1 and 11.2 to the tape system 20. The tape system 20 consists, for example, of tapes 23 and 24. Tape 23 forms a closed loop around rollers 25.1, 25.2 and 25.3 while tape 24 forms a closed loop around rollers 26.1, 26.2, 26.3, 26.4 and rollers 27.1 and 27.2. Roller 25.1, according to an embodiment of the present invention, is located below and laterally offset from the centerline of the folded web 1 coming over the tip 2.1 of the former board 2 and the nip roll pairs 3 and 4. Roller 27.1 is located below and laterally offset in the opposite direction of roller 25.1 from the centerline of the folded web 1. Thus, rolls 25.1 and 27.1 form the opening of a tape funnel 21.

The rollers 26.1 to 26.4 are arranged to form a substantially arced path that changes the direction of the tapes 23 and 24 from a substantially vertical disposition to a substantially horizontal disposition. The tape 23 traverses a loop having the rollers 25 (i.e., 25.1, 25.2, 25.3) on the interior of the loop and having the tape path influenced by the arc of rollers 26.1 to 26.4 on the exterior of the loop. The tape 24 traverses a loop having rollers 26.1 to 26.4 and rollers 27.1 to 27.2 on the interior of the loop. Thus, both tapes 23 and 24 follow the arced path of rollers 26. The tapes 23 and 24 form a tape path exit 29 wherein tape 23 traverses around roller 25.2 and tape 24 traverses roller 27.2.

The tape path exit 29 is adjacent to a first conveyer 30, which, for example, forms a conveyer path around conveyer rollers 32.1 and 32.2. Thus, the signature 10 passes from the tape path exit 29 directly to a conveyor 30, without for example, entering a fan wheel. Such a system prevents, for example, dog-earing and marking of signatures often associated with fan wheels. Conveyer 30 is substantially horizontal, and has assigned to it knock-down wheel 31.

As shown in FIG. 1, knock-down wheel 31 is disposed on the top surface of conveyor 30. The knock-down wheel 31 may be, for example, one of a series of coaxially mounted idler wheels spaced across the width of the conveyor 30 (FIG. 3). The knock-down wheel 31 could also be a single cylindrical roll which extends substantially across the width of the conveyor 30. The knock-down wheel 31 is attached to the frame of the press in a manner that permits the knock-down wheel 31 to rotate about its axis which is substantially perpendicular to the direction of travel of the conveyor 30.

Adjacent to the end of conveyor 30 opposite the tape path exit 29 (e.g., downstream of conveyor 30) is a second conveyer 33 which forms a conveyer path around conveyer rollers 35.1 and 35.2. Conveyor 30 and conveyor 33 are arranged end to end such that conveyor 33 continues the path of conveyor 30. Similar to knock-down wheel 31 on conveyor 30, a second knock-down wheel 34 is assigned to the upper surface of conveyor 33. The knock-down wheel 34 may be positioned at any convenient location along the path of the conveyer to which the knock-down wheel is assigned. As may be found advantageous, more than one set of knock-down wheels may be assigned to a single conveyor.

The arrangement of end to end conveyors may be repeated, as shown, for example, by conveyor 36 placed adjacent to the downstream end of conveyor 33. Conveyor 36 traverses a conveyor path around conveyor rollers 38 and 38.1 (not shown). Thus, a staged deceleration and shingling of signatures 10 may be accomplished without the expense of a fan wheel or deceleration drum system, and without the marking and dog-earing problems associated with fan wheel and deceleration drums.

In operation of the printing press, a web 1, which typically has been printed upon and cooled, passes from the printing units and other processing units to the folder section of the press. The folder includes the former board 2, as shown in FIG. 1. The web 1 is processed over the former board 2 such that the web 1 is typically folded in half longitudinally. The former board 2 has a substantially triangular shape. The web 1 is fed to the former board 2 at the top of the former board 2, where the former board 2 is approximately the same width as the web 1. The former board 2 decreases in width down to the tip 2.1 of the former board 2. The web 1, as it passes over the former board 2, is folded in half as facilitated by the shape of the former board 2, with the tip 2.1 helping form the center folding line longitudinally oriented in the web 1. The web leaves the former board 2 and enters a set of nip rolls 3. The web 1, by virtue of passing over and being folded by the former board, may also be referred to as the former folded ribbon 1. The web 1 is fed through the nip rolls 3 at a press speed $V_p$.

The former folded ribbon 1 is converted into individual signatures 10 as it passes through the cutting cylinders 11.1 and 11.2. Typically, cutting cylinder 11 has a knife or blade 12 that cooperates with an anvil 13 on the opposed cutting cylinder 11.2. After being cut, the signatures 10 enter the tape system 20 through tape funnel 21. The tape system 20 includes the two cooperating tapes 23, 24, as described earlier. Tapes 23 and 24 generally are driven at the same speed as each other. Typically, tapes 23, 24 are driven at a speed $V_t$ which is greater than the speed of the press $V_p$. $V_t$ may typically be approximately 10% faster than $V_p$. Thus, the tape system 20 accelerates the signatures 10 away from the former 2 as they enter the tape funnel 21 to create a space 28 between the signatures 10. The space 28 is known in the art as head-to-tail space 28.

The signatures 10 are driven through the tape system 20 by friction forces exerted by the tapes 23 and 24 on the signatures 10. The signatures 10 enter the tape system 20 at the tape funnel 21 in a, for example, substantially vertical orientation traveling in a substantially vertical direction. The tapes 23 and 24 then direct the signatures 10 along the arced path governed by rollers 26, changing the signatures to a substantially horizontal orientation and direction of travel as the signatures 10 approach the tape path exit 29.

The signatures 10 exit the tape system 20 via tape path exit 29 onto the conveyor 30 which runs, for example, at speed $V_c$. $V_c$ may be less than the press speed $V_p$, by, for example, approximately 10%. The signatures 10 are induced to conform to the speed of conveyor 30 by knock-down wheel 31. Knock-down wheel 31 may be, for example, a set of idler wheels that ride on conveyor 30, a cylindrical roller that spans the width of the conveyor 30, or other suitable knock-down roller means. The knock-down wheel 31 may be held in contact with conveyor 30 by, for example, gravity, spring force, pressure cylinders or other suitable means. Conveyor 30 and knock-down wheel 31 are positioned appropriately downstream of the tape system exit 29 so that the trailing edge **10*b* of a signature 10 will drop below the leading edge 10*a* of the subsequent signature 10** to thereby create a shingled stream.

Figure 2:
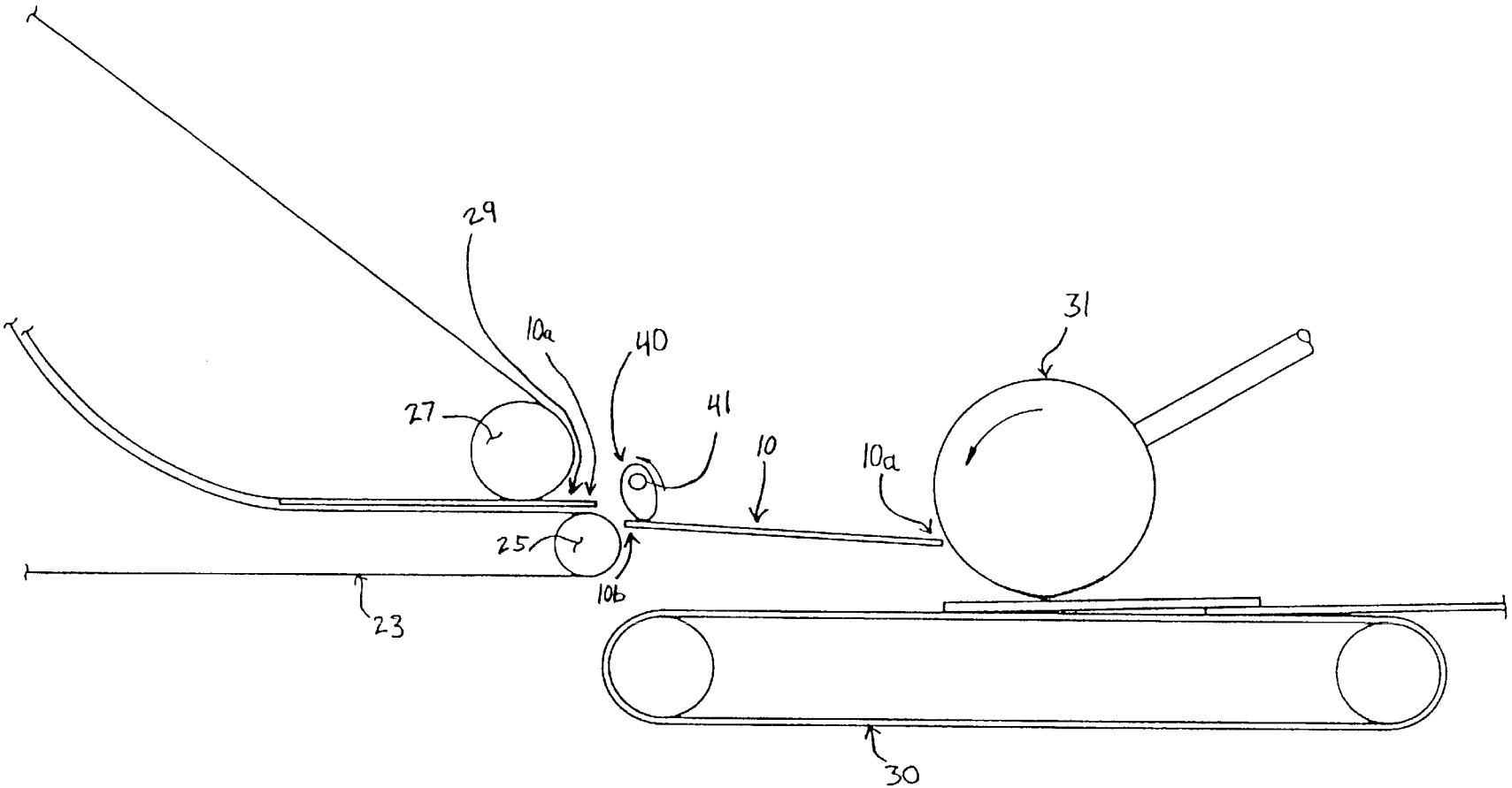
FIG. 2 shows a side view of portion of the apparatus according to a second embodiment of the present invention.

The exemplary embodiment of FIG. 1 represents a relatively simple embodiment of the present invention. For example, additional components such as stationary guides, guide tapes, forced air, vacuum or brush wheels may be used along the path of the signatures 10 to improve the shingling process. For example, the exemplary embodiment shown in FIG. 2 includes an eccentric cam 40 for improving the shingling process. The eccentric cam 40 is located adjacent to and downstream of the tape path exit 29. The eccentric cam 40 may have any appropriate shape, such as circular, or as shown in FIG. 2, oval. Whatever shape the eccentric cam takes, oval, oblong, circular, etc., it must be mounted in an off-center position about an axis of rotation 41. Thus, as the eccentric cam 40 rotates about axis 41, for a portion of the cycle, the eccentric cam 40 is substantially above the axis 41, and for a portion of the cycle, the eccentric cam 40 is substantially below the axis 41.

The rotation of the eccentric cam 40 about the axis 41 can be, for example, synchronized with the feed rate of signatures 10 emerging from the tape path exit 29. Thus, for example, the eccentric cam 40 may have its longer side above the axis 41 as a signature 10 emerges from the tape path exit 29. As the eccentric cam 40 rotates, its longer side comes into contact with and pushes down the trailing edge **10*b* of signature 10. Thus, the eccentric cam 40 helps clear the trailing edge 10*b* of a preceding signature 10 from the path for the leading edge 10*a* of the following signature which will emerge from the tape system 20. By the time the following signature 10 emerges, the eccentric cam 40 has rotated its longer side above the axis 41 and thereby free from the path of the emerging signature 10**.

In operation, for example, the first conveyor 30 and knock-down wheel 31 receive signatures 10 from the tape system 20 and create a shingled stream of signatures. The leading edge 10*a* of a signature 10 approaches the knock-down wheel 31 and will thereby be guided onto the conveyor 30. The knock-down wheel 31 will then push down the trailing edge 10*b* of signature 10 and thus cause the signature 10 to conform to the speed of the conveyor 30. As indicated above, the conveyor 30 is traveling at a speed slower than the press $V_p$ and therefore the signature 10 is slowed down by being placed into conformance with the speed of the conveyor 30. For high speed operation, such as, for example press speed over 1200 fpm, it may be desirable to decelerate signatures 10 to final delivery speed using multiple conveyor and knock-down wheel pairs in order to avoid marking or damage to the signatures 10 that may result from the application of high braking forces to slow down the signatures 10.

When the press speed is relatively high, for example 1200 fpm, and the first conveyor 30 is running, for example, with a speed of 10% less than the press speed, then the first conveyor speed will be too high for handling by the majority of conventional post-folder processing devices such as, stackers, log bundlers, or print rolls, among others. Therefore, it is desirable to incrementally decrease the speed of signatures 10 with additional conveyors 33, 36 and knock-down wheels 34, 37. While FIG. 2 shows three conveyors 30, 33, 36, it is noted that only two may be required in some circumstances, while in other circumstances, more conveyors may be needed and may be used to achieve a desired output speed of the signatures 10. For example, if a spacing between successive signatures 10 on the order of 2 inches is desired, then a multiple series of conveyors and knock-down wheels may be used to achieve such a spacing. FIG. 1 shows signatures 10 exiting conveyor 30 onto conveyor 33. Conveyor 33 may run at a lower speed than conveyor 30. For example, conveyor 33 might be running at approximately 60% of the press speed $V_p$. The knock-down wheel 39 induces the incoming signature stream to conform to the speed of conveyor 33, and the signatures 10 will therefore slide up on each other in front of the knock-down wheel 34 resulting in a shorter shingle spacing.

The number of conveyor and knock-down wheel pairs needed to achieve the proper signature speed and spacing is variable. The actual number of conveyors and knockdown wheels according to the present invention required may be, for example, determined by testing, and typically will be a function of the maximum press speed. FIG. 1 shows a shingled signature stream exiting conveyor 33, which may run at a speed of, for example, 60% of the press speed $V_p$. The shingled stream is further reduced in signature spacing as it conforms to the speed of conveyor 36, which may run at a speed of, for example, 40% or 20% of the press speed.

The arrangement of the conveyors and knock-down wheels according to the present invention employed for the signature spacing reduction process shown in FIG. 1 may be enhanced with additional functional features. For example, if paper frictional or static electrical attraction forces are found to prohibit the signatures 10 from sliding relative to each other, then it may be necessary to arrange successive conveyors as descending steps. By arranging the conveyors in a descending step formation, the signatures experience some separation from each other which helps to relieve the inter-signature forces that can inhibit the desired slide-up effect.

The drive system for the conveyor, tape rollers, cams, and other components of the device according to the present invention can be a single speed tracking drive with the speed reduction of successive units or conveyors mechanically fixed, for example, by belt pulley ratios. Other embodiments of the drive arrangement include, but are not limited to, picking up the mechanical drive from the folder, or using individual speed tracking drives for each component of the device.

What is claimed is:

1. A device for delivering signatures, the device comprising:

a web running at a web speed;

a folder, the folder folding the web;

a cutting device, the cutting device converting the web into signatures;

a tape system receiving signatures from the folder, the tape system running at a tape system speed greater than the web speed thereby increasing a speed of the signatures;

a first conveyor belt disposed adjacent to the tape system, the first conveyor belt receiving signatures from the tape system, the first conveyor belt traveling at a speed slower than the tape system speed;

a first knock-down wheel rotatably mounted above the first conveyor belt and in rolling engagement with the first conveyor belt, the first knock-down wheel forcing signatures into conformance with the speed of the first conveyor belt, a second conveyor belt disposed adjacent to and downstream from the first conveyor belt, the second conveyor belt receiving signatures from the first conveyor belt, the second conveyor belt traveling at a speed slower than the first conveyor belt, and a second knock-down wheel rotatably mounted above the second conveyor belt and in rolling engagement with the second conveyor belt, the second knock-down wheel forcing the signatures into conformance with the speed of the second conveyor belt.

2. A device for slowing down signatures in a printing press, comprising:

an arcuate tape system;

a first conveyor belt operating at a first speed, the arcuate tape system feeding signatures to the first conveyor belt;

a first knock-down wheel disposed above the first conveyor belt;

a second conveyor belt adjoining the first conveyor belt, the second conveyor belt operating at a second speed, the second speed being less than the first speed;

a second knock-down wheel disposed above the second conveyor belt; and wherein the first conveyor belt receives a plurality of signatures, each of the plurality of signatures being urged towards a surface of the first conveyor belt via the first knock-down wheel thereby forming a first shingled stream of signatures traveling at the first speed, the second conveyor belt receiving the first shingled stream of signatures, each of the signatures of the first shingled stream being urged towards a surface of the second conveyor belt via the second knock-down wheel thereby forming a second shingled stream of signatures traveling at the second speed.

3. The device of claim 1, wherein:

the tape system is arcuate.

4. The device of claim 1, wherein:

the tape system is substantially vertical in a location where the tape system receives signatures, and wherein the tape system is substantially horizontal in a location where the tape system releases signatures.

5. The device of claim 1, wherein:

the tape system includes a tape funnel in a location where the tape system receives signatures.

6. The device of claim 1, wherein:

the folder is a triangular former board.

7. The device of claim 1, further comprising:

nip rolls located downstream of the folder.

8. The device of claim 1, further comprising:

at least one cutting tool located downstream of the folder.

9. The device of claim 8, wherein:

the at least one cutting tool includes a knife cylinder.

10. The device of claim 9, wherein:

the at least one cutting tool further includes an anvil cylinder.

11. The device of claim 1, wherein:

the first knock-down wheel includes a series of coaxial idler wheels.

12. The device of claim 1, wherein:

the first knock-down wheel includes a single cylindrical roll.

13. The device of claim 1, wherein:

the second knock-down wheel includes a series of coaxial idler wheels.

14. The device of claim 1, wherein:

the second knock-down wheel includes a single cylindrical roll.

15. The device of claim 1, further comprising:

an eccentric cam located downstream of the tape system.

16. The device of claim 15, wherein:

the eccentric cam is mounted for rotation.

17. The device of claim 2, wherein:

the tape system is substantially vertical in a location where the tape system receives signatures, and wherein the tape system is substantially horizontal in a location where the tape system releases signatures.

18. The device of claim 2, wherein:

the tape system includes a tape funnel in a location where the tape system receives signatures.

19. The device of claim 2, further comprising:

a triangular former board.

20. The device of claim 19, further comprising:

nip rolls located downstream of the former board.

21. The device of claim 19, further comprising:

at least one cutting tool located downstream of the former board.

22. The device of claim 21, wherein:

the at least one cutting tool includes a knife cylinder.

23. The device of claim 22, wherein:

the at least one cutting tool further includes an anvil cylinder.

24. The device of claim 2, wherein:

the first knock-down wheel includes a series of coaxial idler wheels.

25. The device of claim 2, wherein:

the first knock-down wheel includes a single cylindrical roll.

26. The device of claim 2, wherein:

the second knock-down wheel includes a series of coaxial idler wheels.

27. The device of claim 2, wherein:

the second knock-down wheel includes a single cylindrical roll.

28. The device of claim 2, further comprising:

an eccentric cam located downstream of the arcuate tape system.

29. The device of claim 28, wherein:

the eccentric cam is mounted for rotation.

30. A device for delivering signatures, the device comprising:

a press creating signatures, the press running at a press speed;

a tape system receiving signatures from the press, the tape system running at a tape system speed greater than the press speed thereby increasing a speed of the signatures;

a first conveyor belt disposed adjacent to the tape system, the first conveyor belt receiving signatures from the tape system, the first conveyor belt traveling at a speed slower than the tape system speed; and a second conveyor belt disposed adjacent to and downstream from the first conveyor belt, the second conveyor belt receiving signatures from the first conveyor belt, the second conveyor belt traveling at a speed slower than the first conveyor belt.

31. A device for slowing down signatures in a printing press, comprising:

an arcuate tape system;

a first conveyor belt operating at a first speed, the arcuate tape system feeding signatures to the first conveyor belt;

a second conveyor belt adjoining the first conveyor belt, the second conveyor belt operating at a second speed, the second speed being less than the first speed; and wherein the first conveyor belt receives a plurality of signatures thereby forming a first shingled stream of signatures traveling at the first speed, the second conveyor belt receiving the first shingled stream of signatures thereby forming a second shingled stream of signatures traveling at the second speed.

* * * * *